US006079995A

United States Patent [19]

Duhe, Jr.

[11] Patent Number: 6,079,995

[45] **Date of Patent: *Jun. 27, 2000**

[54] PROTECTIVE GROUNDING ELECTRICAL RECEPTACLE WITH REPOSITIONAL PLUG ACCEPTORS

[75] Inventor: Jerry Ronald Duhe, Jr., College Station, Tex.

[73] Assignee: Hubbell Incorporated, Orange, Conn.

[ * ] Notice: This patent is subject to a terminal disclaimer.

[21] Appl. No.: 09/134,440

[22] Filed: Aug. 14, 1998

Related U.S. Application Data

[63] Continuation of application No. 08/602,711, Feb. 16, 1996, Pat. No. 5,795,168.

[51] Int. Cl.[7] ..... H01R 29/00

[52] U.S. Cl. ..... 439/188; 439/346; 200/51.09

[58] Field of Search ..... 439/188, 137, 439/139, 140, 346, 143; 200/51.07, 51.09

[56] References Cited

U.S. PATENT DOCUMENTS 5,795,168 8/1998 Duhe ..... 439/188

*Primary Examiner*—Paula Bradley
*Assistant Examiner*—Alexander Gilman
*Attorney, Agent, or Firm*—Roylance, Abrams, Berdo & Goodman, L.L.P.

[57] ABSTRACT

An electrical receptacle providing repositional plug accepting members which receive and lock into place an inserted electrical plug with or without a ground prong while allowing for manual rotation to on and off positions, the receptacle further utilizes prong slot blocking members to obstruct attempted foreign object insertion when improperly initiated without plug insertion. The empowerment or nonempowerment availability is afforded by repositional plug acceptors moveably secured within the chambers of the body allowing for limited positioning, inward and outward movement is directed by spring members adjacent each plug acceptor in each chamber, a completeable circuit is afforded by conductive members positioned within the body extending into the chambers adapted to ride about the periphery of the plug acceptors during and after repositioning and contact members positioned within the plug acceptors extending to the periphery affording communication with the conductive members after relocation thereby offering a completeable electrical circuit to an inserted electrical plug, similarly the ground receiving members are positioned within the plug acceptors there to receive an inserted ground prong and communicate during and after relocation with grounding means to complete the ground circuit, locking is provided by locking members positioned within the plug acceptors adapted to secure the inserted prongs during repositioning, and empowerment. Foreign object obstruction is provided by blocking members adapted to cover the entry slots having access to the contact members when initiated without electrical plug insertion and to springedly bind against the prongs of an inserted electrical plug ready to cover the entry slots in the case of a forced plug removal.

26 Claims, 3 Drawing Sheets

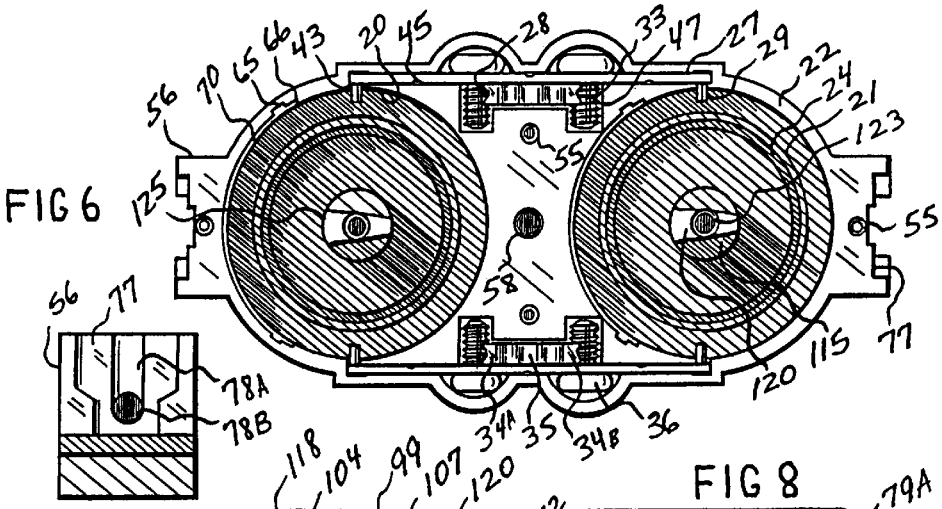
FIG 6
FIG 7
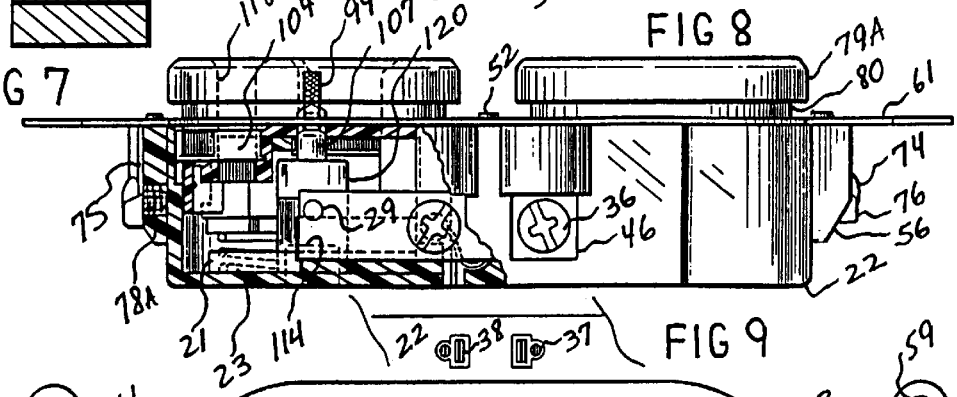
FIG 8
FIG 9
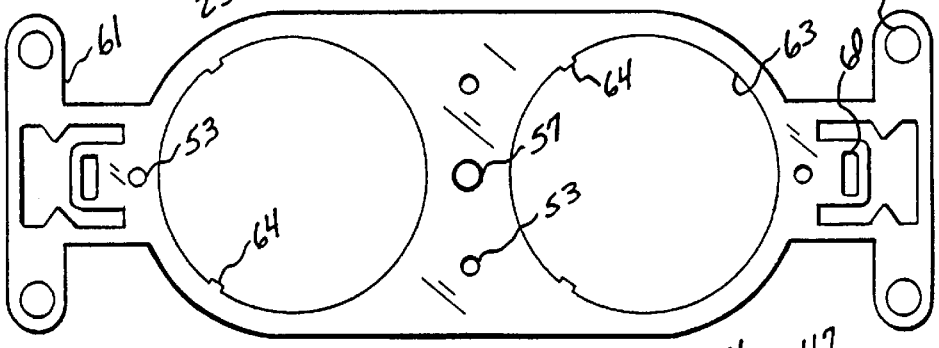
FIG 10
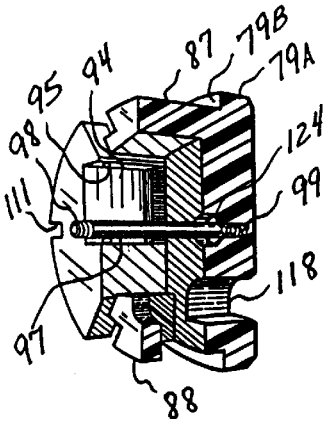
FIG 11
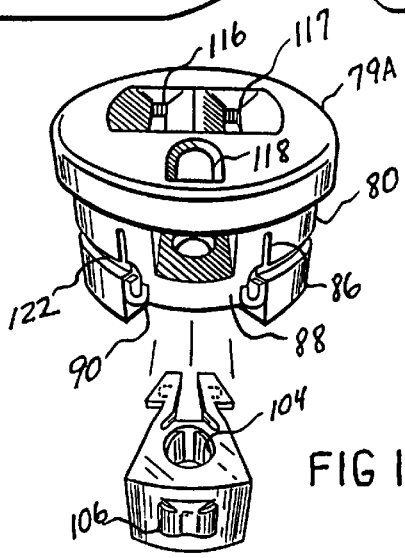
FIG 12

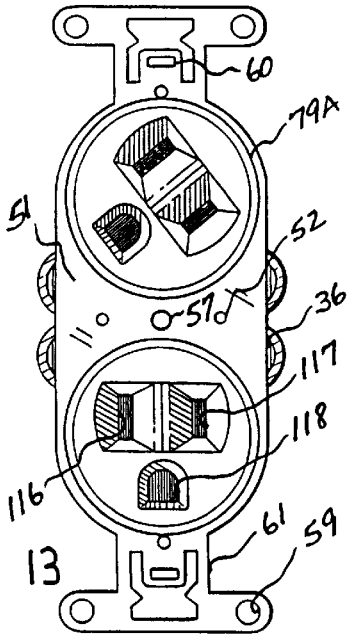
FIG 13
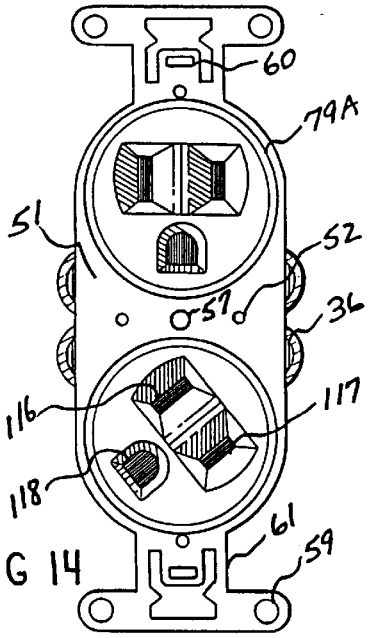
FIG 14
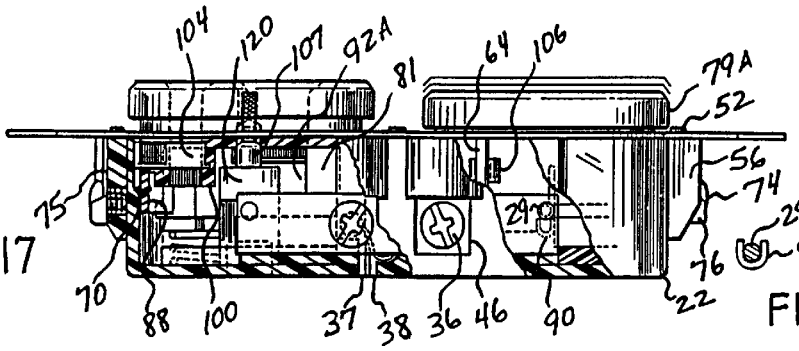
FIG 17
FIG 18
FIG 15
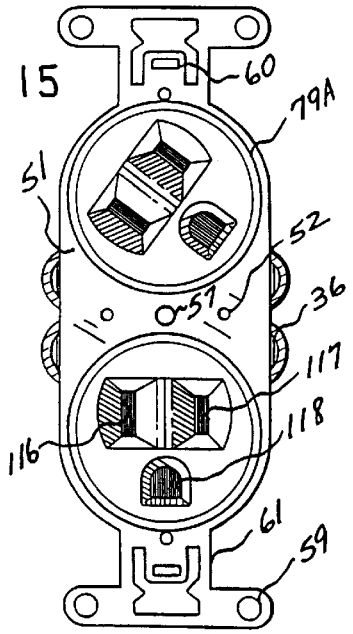
FIG 16
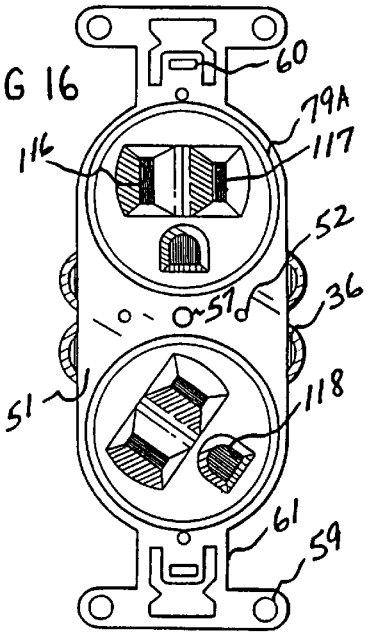

PROTECTIVE GROUNDING ELECTRICAL RECEPTACLE WITH REPOSITIONAL PLUG ACCEPTORS

RELATED APPLICATIONS

This application is a continuation of U.S. patent application Ser. No. 08/602,711 filed Feb. 16, 1996 now U.S. Pat. No. 5,795,168.

BACKGROUND OF THE INVENTION

This invention relates in general to electrical receptacles and in particular to protective electrical receptacles utilizing repositional plug acceptors and other supportive protective features.

DESCRIPTION OF PRIOR ART

Possible electrical shock or physical damage to small children is always a prevalent thought in the minds of most parents and other concerned persons. In addition through our own experiences most of us have found that we too are not exempt from these unexpected accidental electrical mishaps. Many a person has received minor and even life threatening damage by merely inserting an electrical plug into a receptacle while accidently touching one of both prongs.

In the past there have been several receptacles introduced with the thought of lessening the availability of live current to small children, most of which employ rotable closures or shutters located on the front of the device, designed for the most part to keep the slots out of alignment when not in use.

One of these is U.S. Pat. No. 2,515,003 and another U.S. Pat. No. 2,515,870, both would afford some degree of protection to small children, however, there would be no real protection against possible shock to the user who might accidently contact one or both prongs during insertion of an electrical plug.

Other examples utilizing rotable closures and, or shutters with torsion springs are U.S. Pat. No. 2,154,160 and U.S. Pat. No. 2,752,581. These afford a greater degree of protection to small children because the torsion spring would normally hold the slots out of alignment when not use. Here again with these two designs there would still be no real protection to the user who might accidently contact one or both prongs during insertion of an electrical plug.

Another example, intended for somewhat of a different use, nevertheless employing safety features using a rotable type closure, is U.S. Pat. No. 3,663,924 designed to make connections along an electrical cord. This design, as the others, makes live current available as the slots on the closure or shutter align with the slots in the body portion. But, here again no real protection to the user who might accidentally contact one or both prongs during insertion of an electrical plug.

Another design utilizing rotable closures is an extension cord, U.S. Pat. No. 3,879,098, which of course, as the rest affords no real protection to the user who might accidentally contact one or both prongs during insertion of an electrical plug. All of the before-mentioned patents and designs employing rotable closures and or shutters of any type would not be feasible with the introduction of the three prong grounding plug. Up to now as far as I am aware there has been no electrical receptacle designed with movable plug acceptors capable of receiving a three prong grounding plug and supporting such features so as to alleviate or lessen the possibility of shock to the user who might accidentally contact one or both prongs during insertion of an electrical plug.

SUMMARY OF THE INVENTION

There is therefore a need to provide a protective electrical receptacle utilizing such features so as to create a safer environment for the user and the non-user alike in the homes, and the workplace, thereby lessening the risk of possible minor or life threatening shock.

The principle object of the present invention is to provide a protective electrical receptacle employing such safety features so as to considerably lessen the possibility of accidental shock to both children and adults.

It is also an object of the invention to give full control to the user whether he or she desires the electrical receptacle to have live current available at a specific time.

Another object of the invention is to provide a secure and constant connection between the electrically operated device and the electrical receptacle when live current is made available to lessen the possibility of unwanted accidental plug removal, as in the case of electronic or computer related devices which could require possible resetting after the loss of power.

A further object of the present invention is for live current to only be available when initiated properly and completely by an electrical plug of an electrically operated device, and, when not in use to be considered harmless to playing children.

Another object of the present invention is to provide a means of blocking foreign object insertion when initiated improperly there by creating a safer environment for playing children.

And still another object of the present invention is to be designed and constructed in such a way utilizing specific materials for the purpose of economical manufacture and assembly so as to easily replace conventional means adjoining electrically operated devices, appliances, tools or machinery to an electrical power source regardless of the voltage or amperage requirements or plug prong configuration as the spirit of the invention is set forth.

The foregoing objects, as well as other objects, which will become apparent from the discussion that follows are achieved according to the present new invention described herein as a PROTECTIVE GROUNDING ELECTRICAL RECEPTACLE WITH REPOSITIONAL PLUG ACCEPTORS in which one embodiment comprises a rigid plastic or the like nonconductive body having a cover member connected thereto for attachment to stud in wall or a switch box designed for concealment of such. The receptacle would further incorporate conductive members connecting utilizing screws to connect the electrical service and holes in the rear portion of the receptacle for electrical wire insertion as alternate means to contact conductive members and empower the receptacle. The front of the receptacle makes available repositional plug accepting members, which are attached within the body allowing for traverse movement to position the inserted electrical plug to either the one or off positions.

When empowerment is desired an electrical plug with or without ground must be inserted fully and completely into a repositional plug acceptor pushed in slightly and pivoted, either clockwise or counter clockwise which ever is more comfortable. At this point the inserted electrical plug is automatically locked into position by means of locking members not allowing for plug removal while in this process. When this process has been initiated without proper electrical plug insertion the locking members utilize an additional feature by positioning blocking members within the openings of the plug accepting members, not allowing entry to foreign objects in order to prevent possible accidental shock or accessibility to small children. As the plug and plug acceptor reach the on position and are released, the plug acceptor will spring outward slightly to a locked position completing contact with the conductive members thereby closing the circuit and making live current available. When plug removal is desired this process must be reversed. Immediately following the initiation of the reversal process, by pushing the plug acceptor in slightly while holding on the the inserted electrical plug, contact between conductive members will broken, thereby opening the circuit and terminating the availability of live current. As the reversal process continues and the plug and plug acceptor reach the off position the electrical plug is simultaneously released by the locking members allowing for plug removal.

Upon plug removal the plug acceptor will spring outward slightly to a locked position and remain in that state until further initiation.

The present new invention consist of a combination and arrangement of parts here-in-after more fully described and illustrated in the accompanying drawings, and more particularly pointed out in the appended claims, it being understood that changes may be made in form, size, proportions and minor details of construction without departing from the spirit or sacrificing any of the advantages of the invention.

BRIEF DESCRIPTION OF DRAWING

FIG. 6 is a top front elevation of a slightly modified body similar to FIG. 1 revealing interior portions.

FIG. 7 is an end view of the device of FIG. 6.

FIG. 8 is a side view of an assembled Protective Grounding Electrical Receptacle with Repositional Plug Acceptors having a side wall removed to reveal interior fragmented construction details.

FIG. 9 is a fragmentary bottom view of a side portion of the device of FIG. 8 revealing wire insertion area.

FIG. 10 is a top elevation of a typical unassembled cover member as seen in FIG. 8.

FIG. 11 is a prospective fragmented sectional elevation of a typical unassembled plug acceptor as seen in FIG. 5.

FIG. 12 is a prospective elevation similar to FIG. 5 revealing a slightly modified ground contact.

FIGS. 13, 14, 15, 16 are frontal views of the device of FIG. 8 showing alternate positions of the plug acceptors during empowerment and nonempowerment stages.

FIG. 17 is a side elevation similar to FIG. 8 showing further wall removal to reveal alternate movement of a plug acceptor.

FIG. 18 is a fragmentary view of a portion of FIG. 17 revealing contacts in communication after full repositioning.

DETAILED DESCRIPTION OF THE INVENTION

Figures 1, 2, 3, 4, 5:
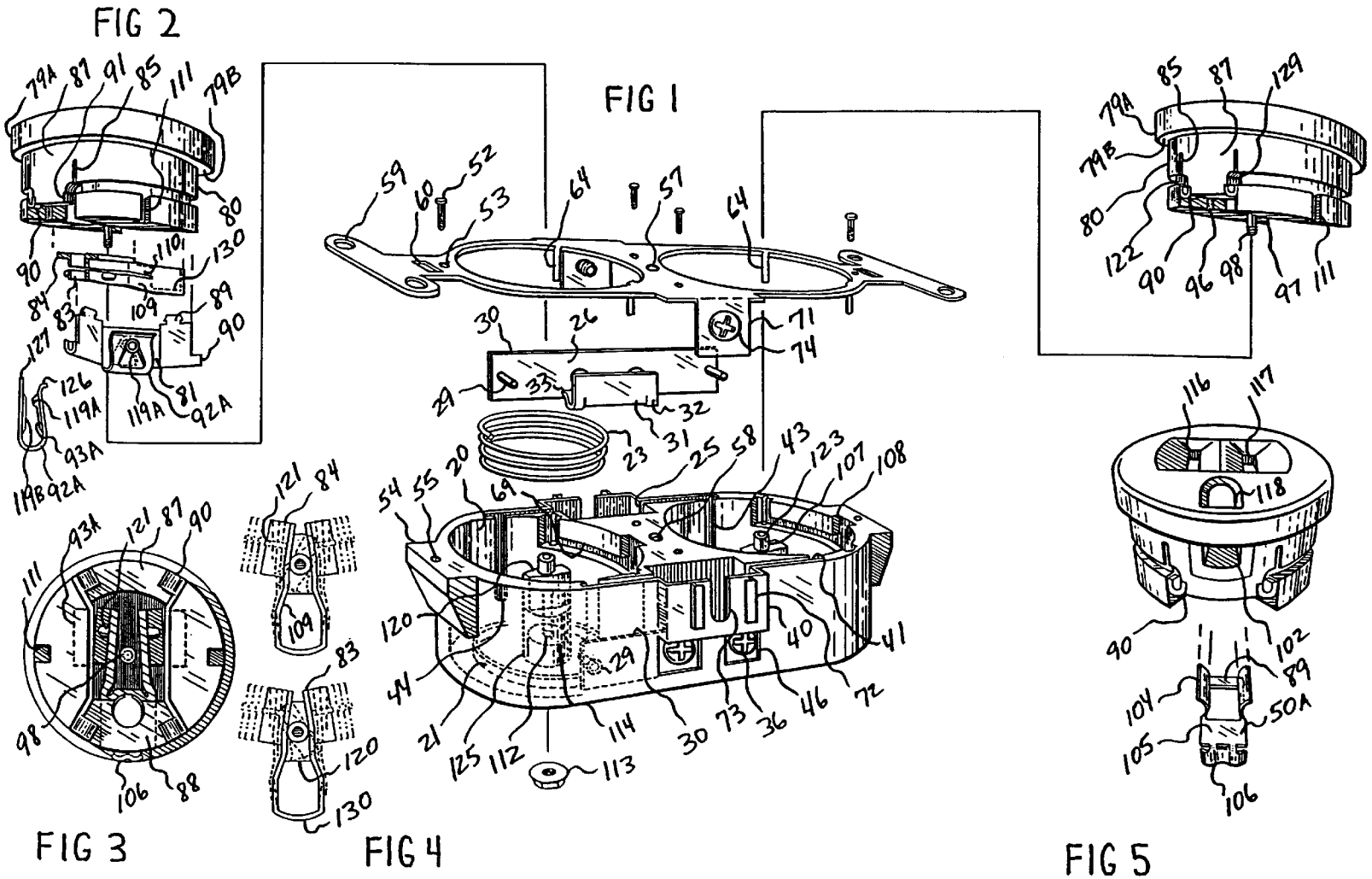
FIG. 1 is a prospective view of a preferred embodiment of the Protective Grounding Electrical Receptacle with Repositional Plug Acceptors in accordance with the present invention revealing component parts before assembly.
FIG. 2 is a fragmentary side view of a portion of FIG. 1 showing further details of a plug prong receiver.
FIG. 3 is a bottom elevation of a typical assembled repositional plug acceptor of the device of FIG. 1.
FIG. 4 is an isolated fragmentary view of the device of FIG. 3 showing alternate movement associated with a locking system.
FIG. 5 is a prospective view of a typical repositional plug acceptor as seen in FIG. 1 revealing the top and rear portion.

Referring to the drawings in detail without imposing any limitations whatsoever on the Protective Grounding Electrical Receptacle with Repositional Plug Acceptors referring now to FIG. 1 there is shown in the drawing an embodiment of the device as set forth in the application. The body 19 is formed from any suitable rigid insulative nonconductive material. The front of the body 19 is provided with a pair of sufficiently recessed circular chambers 20, the interior of each chamber 20 is provided with a containment collar 21 formed integrally with the body 19 which serve to restrict lateral movement of an installed elastic member 23 and also as integral stop to restrict inward movement of the installed repositional plug acceptor 80 as best seen in FIG. 8.

The circular chambers 20 are further provided with a locking system initiation member 120 centrally located in each chamber 20 preferably molded or formed as an integral part of the body 19 as seen in FIG. 1 and the body 22 as seen in FIG. 6.

The circular chambers 20 of the body 22 are further provided with annular depressions 24 of adequate depth and width adjacent the inside diameter of the containment collars 21. The annular depressions 24 are for space utilization and further stabilization of the installed elastic members 23 as seen in FIG. 8.

The body 19 as seen in FIG. 1 is further provided with sufficiently recessed portions 25 adapted to receive conductive members 26. The embodiment as seen in FIG. 6 reveals a slightly modified recessed portions 27 adapted to receive slightly modified conductive members 28. FIGS. 6 and 17 show conductive members 26 and 28 in place and additional interior details.

Conductive members 26 and 28 are formed and constructed of a rigid highly conductive metal of adequate thickness. The conductive members 26 and 28 are provided with substantially tubular contact members 29 at the outer extremities of the traverse crossmembers 30. The conductive members 26 are provided with integral stabilizing members 31 bent in the indicated position, as seen in FIG. 1.

The stabilizing members 31 are provided with two wire clamping members 32 one located at each horizontal edge partially separated but depending from the stabilizing members 31 bent in a substantial S shape having a crescent portion 33 removed from the ends facing the traverse crossmembers 30. The conductive members 28 as best seen in FIG. 6 are provided with two integral wire clamping units having arms 34*a* and 34*b* separated sharing a common dependent base 35 bent as indicated with arms 34*a* and 34*b* formed in a substantial W shape, with remote ends having a crescent portion 33 removed terminating at and partially on connecting screws 36 as seen in FIGS. 6, 8, and 17.

The wire clamping members 32*a* and 32*b*, and 34*a* and 34*b* which act as alternate means to contact conductive members 26 and 28 with electrical current are accessed through four wire lead insertion holes 37 with two located at underside edge of the bodies 19 and 22, two of which are shown in FIG. 9.

The wire lead release slots 38 adjacent the wire lead insertion holes 37 are adapted to receive the appropriate sized tool to access the middle arced portion of the wire lead clamping members 32*a* 32*b*, and 34*a* and 34*b* to springedly release an installed wire lead for removal purposes. Referring to FIG. 1 the conductive members 26 are installed within recesses 25 of the body 19 between body portions 39 and relief members 40.

The outer extremities of the conductive members 26 slide within the openings 41 between the outer surface of the circular chambers 20 and the inside of the exterior walls 42 simultaneously contact members 29 slide down and within receiving slots 43 resting upon installation adjacent the semicircular base 44 with the contact members 29 extending adequately to a predetermined distance within the circular chambers 20, pointing respectively to the geometric center. The stabilizing members 31 similarly rest on the bottom interior of the recesses 25, additionally secured into position by adjacent communication with body portions 45 as seen in FIG. 6, with connecting screws 36 accessible through rectangular openings 46.

Similarly, conductive members 28 are received in like manner within recesses 27 of the body 22 as seen in FIG. 6, with the connecting screw adjustment slots 47 sufficiently recessed to receive the threaded portion of connecting screws 36 rendering access through openings 46 for electrical lead connection as seen in FIGS. 8, and 17.

In addition wire lead clamping members 34*a* and 34*b* rest substantially adjacent the body stops 48 to restrict movement of the wire lead clamping members 34*a* and 34*b* toward the connecting screws 36.

Referring to FIG. 8, the body 22 is provided with elastic members 23 which are preferable made or constructed of a resilient metal or equivalent used to manufacture various springs. The elastic members 23 are positioned in the chambers 20 within the inside diameter of the containment collars 21 for the purpose of providing adequate tension to instruct and restrict inward manually induced movement of the installed repositional plug accepting members 80, during empowerment and nonempowerment stages.

The elastic members 23 of the body 22 as seen in FIGS. 8 and 17 are located further inside annular depressions 24 experiencing additional stabilization and space utilization. The body 19 as best seen in FIG. 1 is further provided with a cover member 49. The body 22 is provided with a slightly modified cover member 51 as best seen in FIG. 9.

The cover members 49 and 51 are preferably die cut or punched out of a light weight rigid metal or an equivalent, which can be formed and portions bent as indicated, and further serve as ground conductors. The cover members 49 and 51 are attached to the bodies 19 and 22 by four knurled set screws 52 positioned through the apertures 53 with two set screws 52 penetrating attachment ears 54 within apertures 55, and with two set screws 52 penetrating the body member 19 as seen in FIG. 1.

Similarly, the end portions 56 of the body 22 as seen in FIG. 6 are penetrated within apertures 55 by two set screws 52, with two additionally penetrating the body member 22 itself. The cover members 49 and 51 are provided with openings 57 for conventional face plate attachment (not shown), by insertion of the appropriate screw within the threaded openings 58 of the bodies 19 and 22 as seen in FIGS. 1 and 6. Additionally, openings 59 and slots 60 located at the end portions 61 of the cover members 49 and 51 are for end use attachment. The cover members 49 and 51 are further provided with openings 62 and 63 which are substantially circular in form and are designed to align with the circular chambers 20 allowing for unobstructed access there-through to the plug accepting members 80.

The cover members 49 and 51 are provided with grounding legs 64 bent as indicated perpendicular therefrom to a designated distance as seen in FIG. 1 and FIG. 12. When the cover members 49 and 51 are fully affixed to the body portions 19 and 22 the grounding legs 64 are positioned within the grooves 65 of the recessed slots 66, extending adequately within positioning slots 67. Slots 66 and 67 are located at the upper edge of the inner walls of the circular chambers 20 as seen in FIGS. 1 and 6.

FIG. 1 reveals containment guides 68 found within chambers 20 of the body 19, adjacent recessed channels 69. Containment guides 68 act as integral stop and tributary border. Further the grounding legs 64 are accessible through recessed channels 69 and 70 of both body portions 19 and 22.

The cover member 49 is provided with grounding flags 71 which parallel edges are received upon attachment into slots 72. Slots 72 act to additionally secure the ground wire lead during connection. Slots 73 of the relief portions 40 are adapted to receive the threaded portion of ground connecting screws 74 during and after installation. Similarly, the end portions 56 of the body member 22 as seen in FIG. 6 are adapted to receive and secure into position grounding flags 75, which are bent as indicated and provided with integral ground wire lead stabilizers 76 with the grounding flags 75 adjacent recessed slots 77. The end portions 56 are further provided with slots 78*a* for the reception of ground connecting screws 74 with recesses 78*b* adapted for ground screw adjustment.

The repositional plug acceptors 80 as seen in FIGS. 1, 2, 3, 10, are preferably formed of a one or two piece rigid insulative material such as plastic, ceramic, nylon or similar consisting of two levels, one of which is the plug accepting portion and outer head 79*a* and the plug accepting body 80 which houses the receiving contact members 81 and 82 and the locking members 83 and integral blocking members 84. The outer head 79*a* is further provided with recessed slots 116, 117, 118 having dimensions generally corresponding to those of the prongs of a typical attachment plug with or without ground.

Receiving contact members 81 and 82 are positioned within the body unit 80 through recessed slots 85 and 86, located between the rotating unit body 80 and containment portions 87 and 88 as seen in FIGS. 3, 5, 11, 12. Anchoring teeth 89 penetrate the body portion 80 through further insertion into the recessed slots 85 and 86 there to frictionally secure the receiving contact members 81 and 82 into position. Contact encasement members 90 of receiving contact members 81 and 82 are bent as indicated in a substantial U shape and are received between the rotating unit body 80 and the containment portions 87 and 88 and are positioned within the peculiar shaped slots 91*a* and 91*b* as seen in FIGS. 1, 5 and 12. The plug pronged receptors 92*a* and 92*b* of the receiving contact members 81 and 82 are bent in the indicated position and provided with depressions 93*a* and 93*b* and are found within containment slots 94 after insertion.

The plug prong receptors 92*a* and 92*b* are held in place by positioning nodules 95 as seen in FIG. 3 and FIG. 11. Recessed slots 96 of the rotating body 80 as seen in FIGS. 3 and 11 are for the removal of receiving contact members 81 and 82 by appropriate plier tip insertion.

Positioning pilot rods 97 of the rotating plug acceptors 80 are metal set screw studs with limited threading 98 on one end and knurling 99 on the other which is setably positioned securely in the center of the repositional plug acceptor head portions 79*a* as best seen in FIGS. 8, 11, and 17.

The locking members 83 and the integral blocking members 84 as seen in FIGS. 1, 3, and 4, are formed of a high grade polycarbonate or an equivalent resilient plastic of adequate strength. The blocking members 83 are positioned within the rotating body 80 adjacent the positioning member 100 and containment portion 88 secured into place by the integral body nodule 101 adjacent crossmember 130 as best seen in FIGS. 3 and 11. The locking members 83 and integral blocking member 84 are designed in such a way that they may be snapped in or out as an option and not interfere with the working of the plug acceptors 80, continuing to give full control of power availability to the user, which will be discussed later in full detail.

Referring to FIGS. 3, 5, and 12 the rotating plug acceptors 80 are provided with ground receiving members 50*a* which are constructed of a highly conductive metal and are positioned within the rectanguloid openings 102 of the containment portions 88.

The ground receiving members 50*a* and 50*b* are secured into position by means of integral anchoring teeth members 89 which further penetrate slot 103 as seen in FIGS. 8, 11. The ground receiving members 50*a* and 50*b* are provided with ground prong reception leaves 104, bent as indicated for adequate communication with an inserted ground prong allowing access through openings 105. In addition the ground reception members 50*a* and 50*b* are further provided with contact portions 106 bent as indicated in a substantial W shape for a tension communication with grounding legs 64 of the cover member 49 and 51. Allowing for frictional movement along the grounding legs 64.

As a fully assembled rotating plug acceptor 80 is installed, positioning pilot rod 97 will penetrate the apertured stud 107 of the locking system initiation member 120 as seen in FIG. 1. Upon further insertion the ground contacting member will move into slot 108 of the body 19. Similarly, the ground receiving member 50*b* will be inserted into the recessed channel 70 of the body 22 as seen in FIGS. 6 and 8.

The locking system initiation member 120 which is a substantially blunt pie shape will slide to a predetermined distance between the arms 109 of the locking members 83 stopping short of communication with arms 110 of the blocking members 84 as seen in FIG. 1. Similarly entry slots 111 will slide down and over contacts 29 of the conductive members 26 and or 28 to a designated spot.

At this point the positioning pilot rod 97 is received through openings 112 making the limited threading 98 available to the washer nut combination 113 for attachment within depression 114 as seen in FIG. 1.

The threading 98 on the pilot rod 97 is minimal in order to allow a completely installed rotating plug acceptor 80 to have limited inward and outward movement. This inward movement is further limited by the collar members 21 and the circular boss 115 of the initiation member 120 as seen in FIGS. 7.

When the Protective Grounding Electrical Receptacle with Repositional Plug Acceptors has been completely assembled as seen in FIGS. 7 and 12, then connected to live current by means of adjoining electrical leads to connecting screws 36 and connected to remote ground service by connection to ground connecting screws 74, live current will be available to the conductive members 26 and 28 only. To make live current accessible to the rotating plug acceptors 80, an electrical plug, with or without ground, must be inserted into a plug accepting member 80, with one prong inserted within opening 116, and the other prong within opening 117 and if available a ground prong into opening 118.

During insertion the two substantially flag prongs are guided into position by plug prong reception members 92*a* and 92*b*, and held in the proper place by adequately tensioned restricting depressions 93*a* and 93*b*, with the annular flange lip apertures 119*a* and apertures 117*a* being located adjacent and substantially aligned within the apertures of the plug prongs as seen in FIG. 1 and 2 assuring a proper alignment for penetration of the locking pins 121. After full insertion while holding on to the electrical attachment plug, the repositional plug acceptors 80 must be pushed in slightly until it stops as seen in FIG. 12. This will unlock the plug acceptor 80 allowing for clockwise or counter clockwise movement as seen in FIGS. 13, 14, 15, and 16. During this repositional process the contact members 29 of the conductive members 26 and 28 are inserted fully within the entry slots 111 of the repositional plug accepting members 80 as seen in FIG. 1, with inward movement terminating with contact members 29 located at the top of the inner portion of the peripheral channelways 122. Simultaneously, the beveled lip 123 of the apertured stud 107 will be inserted into the circular depression 124 of the head 79*a* as seen in FIGS. 8, 11, and 17 thereby fully concealing the positioning pilot rod 97 during the empowerment process.

At the same time the substantially flat, circular boss 115 of the locking system initiation base 125 will communicate with the bottom portion of the locking member arms 109. Also, with full insertion the locking system initiation member 120 will be, fully inserted positioned between locking arms 109 stopping short of engagement with integral blocking member arms 110 as seen in FIGS. 8, and 17 with the annular boss 79*b* located underside the head 79*a* adjacent cover members 49 and 51. Simultaneously, the ground receiving contact member 106 will proceed and rest within the center portion of the recess channels 69 and 70 of both body members 19 and 22. As the turning process either clockwise or counterclockwise is initiated, immediately the locking members 83 and the integral blocking members 84 are engaged by the stationary locking system initiation member 120, which forces the locking arms 109 apart, as seen in FIG. 4, thereby moving the pin studs 121 into and through the flanged apertures 119*a* with intent to proceed through the apertured portion of the inserted plug prongs to rest within the depressed flange apertures 119*b*.

At this point the inserted electrical plug cannot be removed. Additionally the blocking members 84 springedly press on the two substantially flag prongs of the inserted plug ready to cover the insertion slots 116 and 117 in case of a forcibly removed electrical plug. The blocking arms 110 are not directly engaged by the locking system initiation member 120 so as to accentuate the spring effect, in order to not exert to much force on the blocking members 84 as they bind against the inserted prongs.. If this process were initiated without proper electrical plug insertion the blocking members 84 would cover the two elongated parallel insertion slots 116 and 117 by sliding over the top of the plug prong receivers 81 and 82 adjacent containment lip 126 and stabilizing lip 127 to rest within the recessed slots 128 of the containment slots 94 as seen in FIG. 11. It must be stated, if the locking members 83 and integral blocking members 84 have been removed the locking and blocking feature will be sacrificed without effecting the feature to provide empowerment or nonempowerment availability.

As the initiated turn continues the contact members 29 are moved within and along peripheral channelways 122 until movement is terminated at integral stops 129, with contact members 29 of the conductive members 26 and, or 28 just apart from the encasement contacts 90 of the receiving contact members 81 and 82 as seen in FIG. 17.

Similarly, the contacts 106 of the ground receiving members 50*a* and, or 50*b* moves along and within the recessed channels 69 and 70, communicating with grounding leg 64 making the ground connection first, as seen in FIG. 17. Upon full repositioning as seen in FIGS. 13, 14, 15, and 16 there will be no live current available to the plug acceptor 80 or the inserted electrical plug until they are released. Upon release the elastic member 23 will reposition the plug acceptor 80 to an outward locked position simultaneously contact is made between encasement contact members 90 of the plug acceptor 80 and contact members 29 of the conductive members 26 and, or 28 as seen in FIG. 18, thereby, closing the circuit and making live current to the plug acceptor 80 and the inserted electrical plug.

For removal of the electrical plug when the locking system is utilized the above process must be reversed. Immediately following the initiation of the reversal process by pushing the inserted plug and plug acceptor 80 in slightly, contact between encasement contact members 90 and contact members 29 is broken thereby, opening the circuit and terminating the availability of live current. As the plug and plug acceptor reach the intermediate off position, the inserted electrical plug is automatically released by the locking members 83. Upon plug removal simultaneously the plug acceptor 80 is again repositioned outward slightly to a locked position by the elastic member 23.

It is set forth and understood that some appliances, tools, machinery and other electrically operated devices will require varying plug prong accepting configurations and or voltage and, or amperage requirements per each application. All of these alterations are within the guidelines and the scope of the invention and its intention. The foregoing description of the preferred embodiments of the invention has been presented for the purpose of illustration and description. It is not intended to be exhaustive non to limit the invention to the precise forms disclosed. It is therefore understood that other and different embodiments of the invention embracing the same or equivalent principles may be used and varied within the scope of the appended claims and structural changes by made to accommodate various applications by those skilled in the art without departing from the invention.

In light of the above teaching it is intended that of the invention be limited not by this detailed description, but rather by the claims appended hereto.

What is claimed:

1. An electrical receptacle comprising;

1) a receptacle body having a cavity;

2) a plug receptor adapted to be received in said cavity in said receptacle body, said plug receptor having a central axis and adapted to rotate about said central axis and move axially along said central axis in said cavity, said plug receptor having an electrically conductive portion electrically engageable with an electrical plug;

3) a spring disposed between said plug receptor and said receptacle body and applying an outward force to said plug receptor away from said receptacle body; and 4) a contact member coupled to and protruding from said receptacle body for electrically contacting said electrically conductive portion of said plug receptor;

wherein, when a user applies an axial force against said plug receptor and moves said plug receptor axially of said receptacle body, then rotates the plug receptor a predetermined amount, and releases the axially applied force, resulting in the plug receptor moving axially outward away from said receptacle body, the contact member and the electrically conductive portion engage to form an electrical connection between the plug receptor and the receptacle body.

2. The electrical receptacle of claim 1, wherein a portion of said electrically conductive portion is disposed in a depression in said plug receptor and said contact member is a conductor pin that engages with said electrically conductive portion in the depression.

3. The electrical receptacle of claim 1, wherein engagement of said contact member and said electrically conductive portion results in locking of said plug receptor against rotation of said plug receptor without first applying the axial force by the user.

4. The electrical receptacle of claim 1, wherein said plug receptor further comprises a channel that traverses a surface of said plug receptor received in said receptacle, and wherein said contact member is disposed in said channel during rotation of said plug receptor.

5. The electrical receptacle of claim 4, wherein a portion of the electrically conductive portion is disposed at a first end of said channel.

6. The electrical receptacle of claim 1, and further comprising a tab that locks the electrical plug and prevents axial removal of the electrical plug from said plug receptor.

7. The electrical receptacle of claim 6, wherein the tab locks the electrical plug after rotation of said plug receptor.

8. The electrical receptacle of claim 6, wherein a protrusion on said tab engages a hole in the electrical plug.

9. The electrical receptacle of claim 6, wherein a protrusion on the tab engaged a detent on the electrical plug.

10. The electrical receptacle of claim 6, wherein a camming mechanism moves said table into a locking position during rotation of said plug receptor.

11. An electrical receptacle, comprising;

a receptacle body having a cavity;

a spring-loaded plug receptor adapted to be received in said cavity in said receptacle body, said plug receptor having a central axis and adapted to rotate about said central axis and move axially along said central axis in said cavity, said plug receptor having an electrically conductive portion electrically engageable with an electrical plug, said plug receptor further comprising an electrical plug locking mechanism for locking the electrical plug within the plug receptor; and a contact member coupled to and protruding from said receptacle body for electrically contacting said electrically conductive portion of said plug receptor;

wherein, when a user inserts the electrical plug into said spring-loaded plug receptor and applies an axial force against said spring-loaded plug receptor and moves said spring-loaded plug receptor axially of said receptacle body, then rotates the plug receptor a predetermined amount, the electrical plug is locked into the plug receptor; and wherein, when the axial force is released, said plug receptor moves axially outward away from said receptacle body, the contact member and the electrically conductive portion engage to form an electrical connection between the plug receptor and the receptacle body.

12. The electrical receptacle of claim 11, wherein said electrical plug locking mechanism comprises a tab that locks said electrical plug and prevents axial removal of said electrical plug from said plug receptor.

13. The electrical receptacle of claim 12, wherein said tab locks said electrical plug after axial rotation of said plug receptor.

14. The electrical receptacle of claim 12, wherein a protrusion on said tab engages a detent in said electrical plug.

15. The electrical receptacle of claim 12, wherein a protrusion on said tab engages a hole in said electrical plug.

16. The electrical receptacle of claim 12, wherein a camming mechanism moves the tab into a locking position during rotation of said plug receptor.

17. An electrical receptacle comprising;

a receptacle body having a cavity;

a plug receptor adapted to be received in said cavity in said receptacle body, said plug receptor having a central axis and adapted to rotate about said central axis and move axially along said central axis in said cavity, said plug receptor having an electrically conductive portion electrically engageable with an electrical plug;

a spring disposed between said plug receptor and said receptacle body and applying an outward force to said plug receptor away from said receptacle body; and a contact member coupled to and protruding from said receptacle body;

wherein, when a user applies an axial force against said plug receptor and moves said plug receptor axially of said receptacle body, then rotates the plug receptor a predetermined amount, said contact member and said plug receptor releasably engage to prevent counter rotation of said plug receptor.

18. The electrical receptacle of claim 17, wherein the engagement of said contact member and said plug receptor form an electrical connection between said plug receptor and said receptacle body.

19. The electrical receptacle of claim 17, wherein said plug receptor further comprises a channel that traverses a surface of said plug receptor received in said receptacle, and wherein said contact member is disposed in said channel during rotation of said plug receptor.

20. The electrical receptacle of claim 19, wherein said channel further comprises a channel stop, and wherein engagement of said contact member with said channel stop releasably locks said plug receptor and prevents plug receptor movement.

21. The electrical receptacle of claim 20, wherein said plug receptor movement is one of axial movement and rotational movement.

22. A method for applying electrical power to an electrical plug from an electrical outlet, comprising the steps of:

inserting prongs of an electrical plug into a plug receptor in the electrical outlet;

applying an axial force to the electrical plug, thereby moving the electrical plug and the plug receptor into the electrical outlet;

rotating the electrical plug and the plug receptor a predetermined amount; and releasing the axially applied force and biasing the electrical plug and the plug receptor outwardly of the electrical outlet to form an electrical connection between the electrical plug and the electrical outlet.

23. The method of claim 22, further comprising the step of locking the prongs within the plug receptor during rotation of the electrical plug within the plug receptor.

24. The method of claim 22, wherein the outward bias of the plug receptor prevents rotation of the plug receptor.

25. The method of claim 22, further comprising the step of locking the prongs within the plug receptor after rotation of the electrical plug within the plug receptor.

26. The method of claim 25, wherein locking of the prongs within the plug receptor prevents counter rotation of the plug receptor.

* * * * *